US005597070A

United States Patent [19]

Wu

[11] Patent Number: 5,597,070

[45] Date of Patent: Jan. 28, 1997

[54] LAMP STRING HOLDING CONTAINER STRUCTURE

[76] Inventor: Gordon K. H. Wu, No. 51. Liching Erh Street, Keelung City, Taiwan

[21] Appl. No.: 562,759

[22] Filed: Nov. 27, 1995

[51] Int. Cl.[6] ..... A65D 85/42

[52] U.S. Cl. ..... 206/419; 206/485; 206/589; 229/195

[58] Field of Search ..... 206/419–422, 206/485, 589, 590; 229/195

[56] References Cited

U.S. PATENT DOCUMENTS

| | | | |
|---|---|---|---|
| 2,851,158 | 9/1958 | Gish et al. | 206/419 |
| 3,084,790 | 4/1963 | Lugt, Jr. | 206/589 |
| 3,507,441 | 4/1970 | Wilcox et al. | 229/195 |
| 4,485,922 | 12/1984 | Desmond et al. | 206/485 |
| 4,971,200 | 11/1990 | Huang et al. | 206/420 |
| 5,317,491 | 5/1994 | Lee | 206/421 |
| 5,505,309 | 4/1996 | Taravella et al. | 206/589 |

*Primary Examiner*—Jimmy G. Foster
*Assistant Examiner*—Nhan Lam
*Attorney, Agent, or Firm*—Ostrolenk, Faber, Gerb & Soffen, LLP

[57] ABSTRACT

A lamp string holding container includes a bottom having four side panels to define a container in which inverted V-shaped ridges are provided with a plurality of lamp retaining holes spaced along the ridges to each receive therein a lamp. The container is made of a single sheet of paperboard by cutting and folding the paper blank.

8 Claims, 4 Drawing Sheets

LAMP STRING HOLDING CONTAINER STRUCTURE

FIELD OF THE INVENTION

The present invention relates to a lamp string holding container particularly for packing lamp string made of a number of lamps connected with electrical wires for decoration purpose and in particular to a lamp string container made of paperboard to be self-constructed without external fasteners.

BACKGROUND OF THE INVENTION

Lamp strings have been widely used for decoration, especially in celebration or night festivals. The lamp strings which are usually composed of a number of small lamps, preferably having coatings or different colors on the lighting bulb thereof, connected with conductive wires, are usually packed within a container made of a paper blank folded and stapled to form a rectangular receptacle for receiving therein soft padding materials, such as paper fragments, foams, to pad under the lamp string for protection of the lamps from being damaged due to hitting the container during handling and/or transportation. In such an arrangement, the lamps are not securely fixed inside the container and are allowed to move so that collision between lamps often occurs. This damages the lamps.

Further, the formation of the paper container by means of stapling is a labor-consuming job and thus the manufacturing efficiency cannot be increased effectively.

To overcome the problems encountered in such a prior art lamp packing container structure, device for containing/holding made of injection-moldable material, such as plastics, was developed. An example of the injection-molded lamp holder is illustrated in FIG. 1 of the attached drawings. The prior art lamp holder shown in FIG. 1, which is generally designated at 10, comprises a plurality of strip pairs, having a first strip 11 and a second strip 12. On one of the strips, for example the first strip 11, a plurality of lamp base holding slots 13 are formed to each receive and hold therein the base 14 of one of the lamps 15. On the second strip 12, a plurality of lamp bulb holding holes 16, opposing the slots 14, are formed to receive therein the lamp bulb 17 which is electrically received and secured to the base 14. The bases 14 of the lamps 15 are electrically connected together with electrical wires 18.

The plastic injection-molded lamp holder, although capable to effectively secure the lamps individually, has yet certain drawbacks, such as:

(1) Some of the plastic materials that are conventionally used to make the lamp holder is, to some extent fragile, as compared to paperboard.

(2) The contact between the lamp bulbs, which is usually coated with different colors, and the holding ring (reference numeral 16 of FIG. 1) of the lamp holder resulting from the vibration and shock during transportation and/or handling may sometimes cause damage to the colorful coatings of the lamps.

(3) Plastics, which is well known to be incapable to decompose naturally, may casus environmental pollution problem.

(4) The holding of the lamp within the conventional holder requires separate devices to respectively holding the lamp base and the lamp bulb which is complicated in structure.

It is therefore desirable to provide a lamp string holding container structure which overcomes the above-mentioned drawbacks of the prior art structure.

SUMMARY OF THE INVENTION

The principal object of the present invention is to provide a lamp string holding container which is capable to effectively secure the lamps of the lamp string inside the container by providing, on the bottom of the container, inverted V-shaped ridge formed by folding the blank used to form the bottom of the container, each ridge having a plurality of holes to receive and retain lamps therein.

It is another object of the present invention to provide a lamp string holding container which is made of a single sheet of paperboard by cutting and folding the paperboard to form a container having a bottom with four side panels, the side panels having foldable flaps to engage corresponding slits formed on the adjacent panels to form the container.

It is a further object of the present invention to provide a lamp string holding container which needs no external fastener in forming the container.

It is a further object of the present invention to provide a lamp string holding container which is made of a single sheet of paperboard so as to overcome the pollution problem caused by the conventional plastic products.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
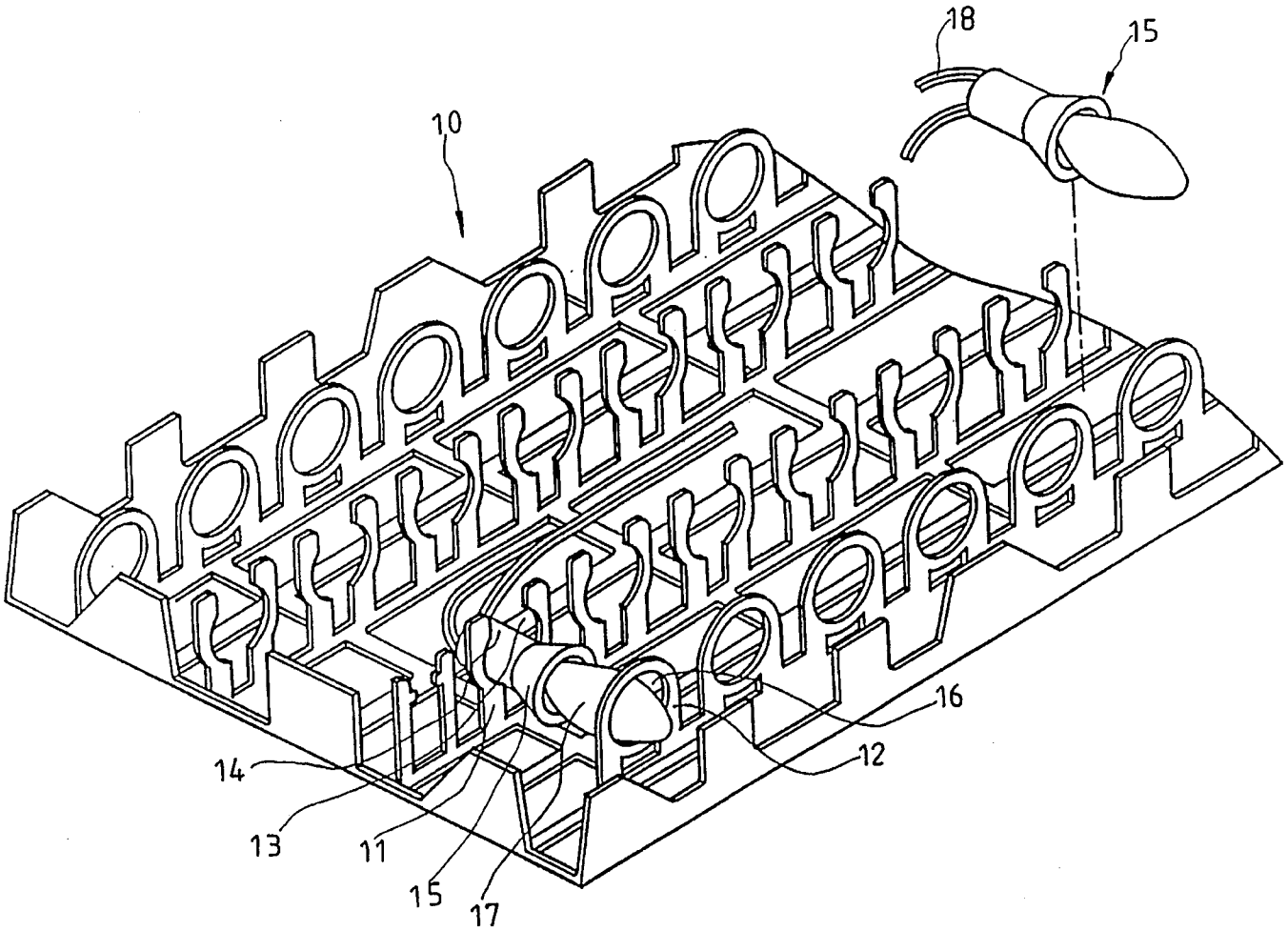
FIG.1 PRIOR ART
FIG. 1 is a perspective view showing a prior art lamp holder structure.
Figure 2:
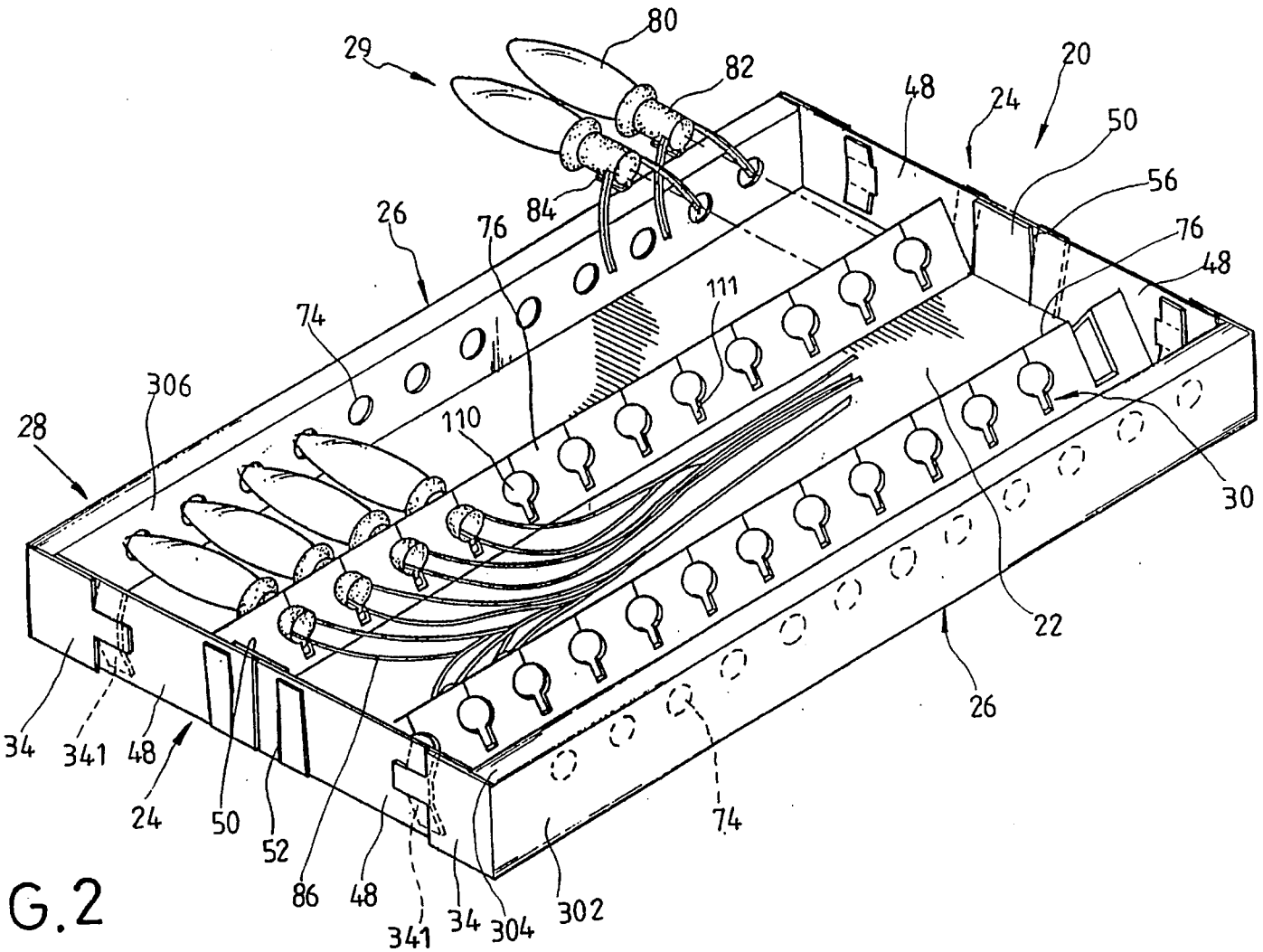
FIG. 2 is a perspective view showing a lamp string holding container constructed in accordance with the present invention.

With reference to the drawings and in particular to FIG. 2, wherein a lamp string holding container constructed in accordance with the present invention, generally designated with the reference numeral 20, is shown, the lamp string holding container 20 which is made of a paperboard blank 200 (see FIGS. 3 and 4) comprises a bottom 22, preferably in the form of a rectangle having two opposite end sides from which end panels 24 extend to be substantially normal to the bottom 22 (upright position) and two opposite lateral sides from which side panels 26 extend to be substantially normal to the bottom 22 (upright position). Thus, in the embodiment illustrated, the end panels 24 are substantially normal to the bottom 22 and the side panels 26 and similarly, the side panels 26 are substantially normal to the bottom 22 and the end panels 24. The bottom 22, together with the end panels 24 and the side panels 26, constitute a receptacle 28 in which lamp securing means 30 (to be further discussed hereinafter) is arranged for securing therein a plurality of lamps 29 of the lamp string.

Figure 3:
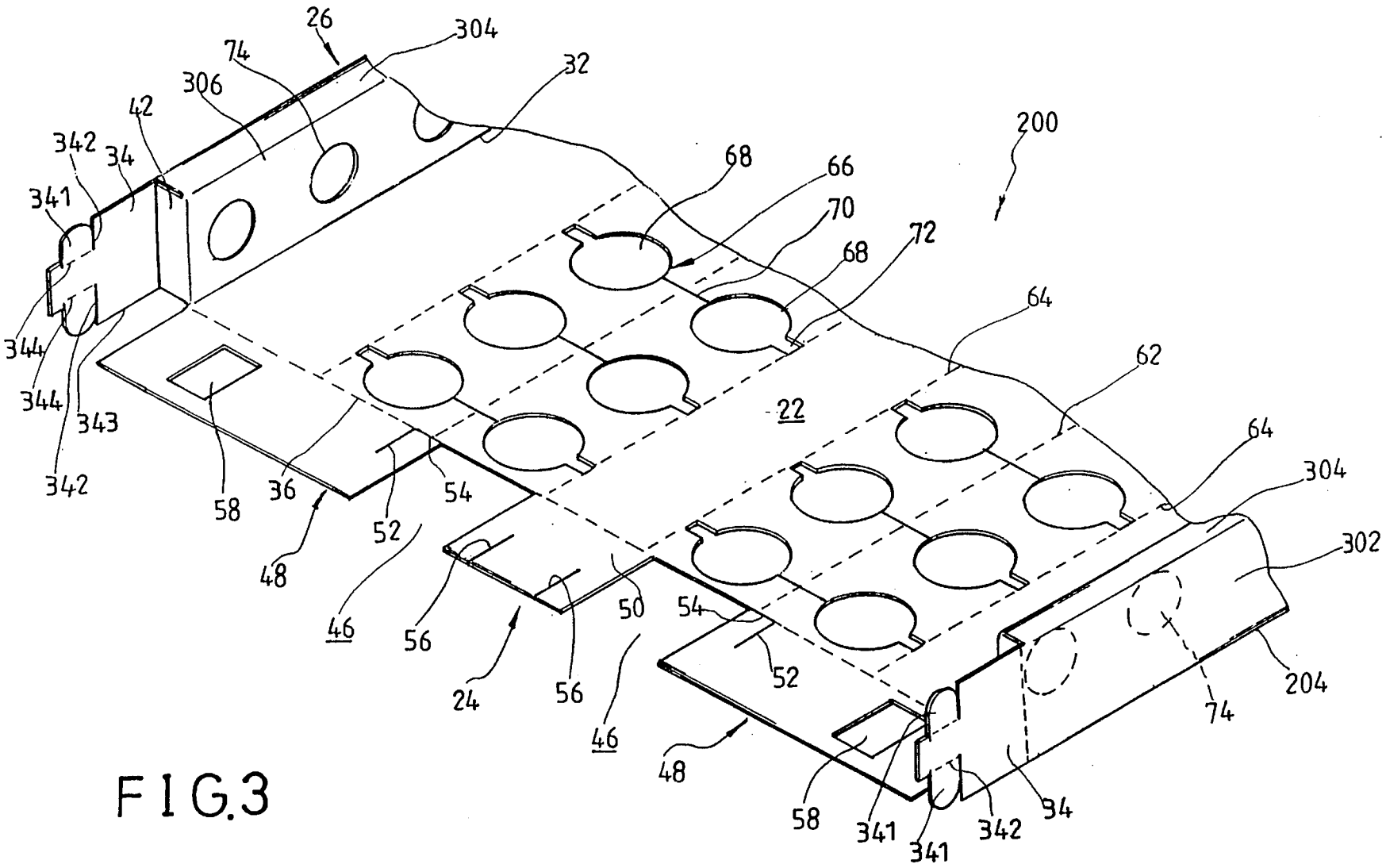
FIG. 3 is an enlarged perspective view showing an end portion of the lamp string holding container of the present invention, partially folded.
Figure 4:
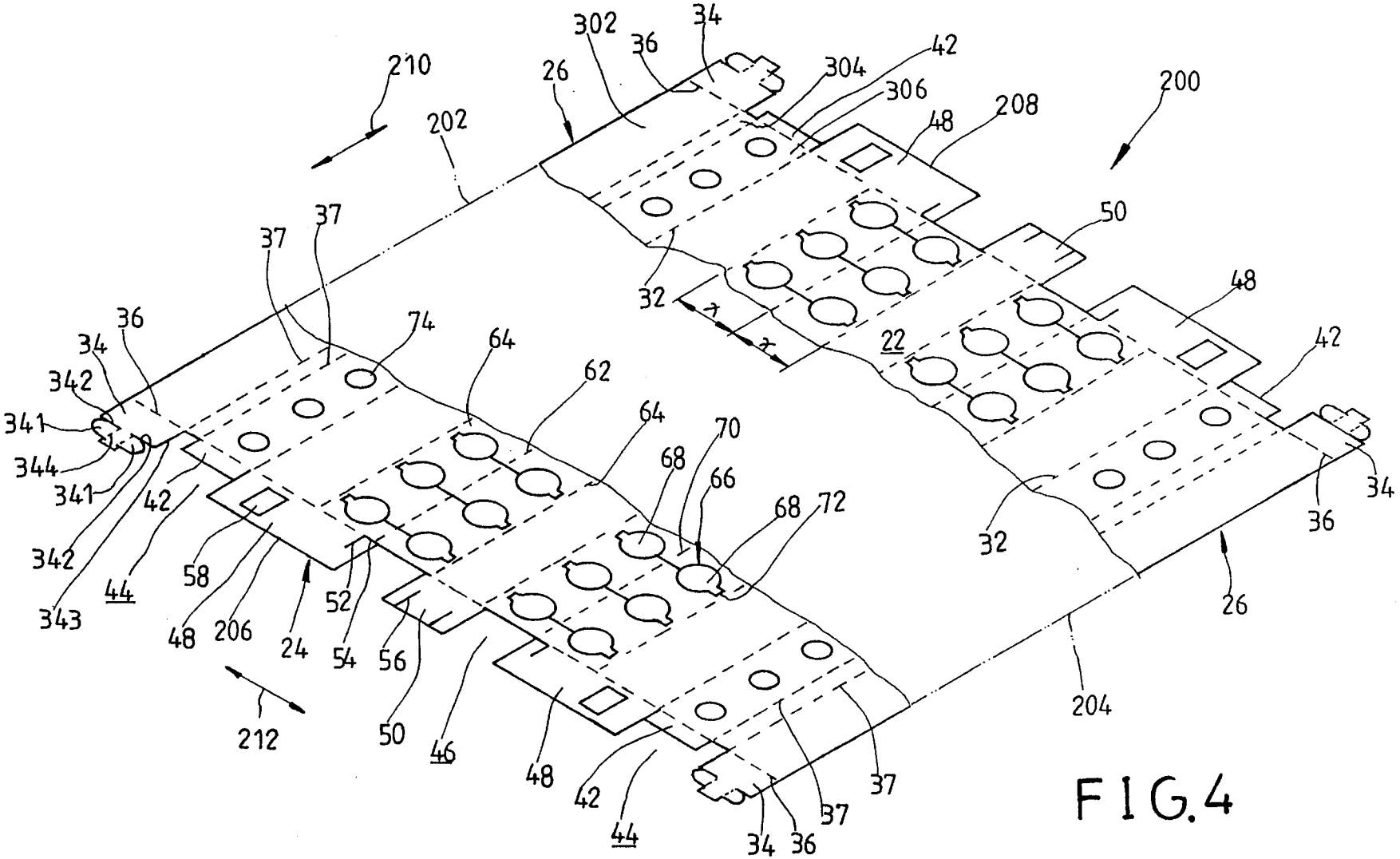
FIG. 4 is a plan view of the paperboard blank used to form the lamp string holding container of the present invention.

Also referring to FIGS. 3 and 4, the lamp string holding container 20 of the present invention is made by folding a paperboard blank, generally designated with the reference numeral 200, which in the embodiment illustrated is a substantially rectangular paperboard having first and second longitudinal edges 202 and 204 running along a longitudinal direction (indicated by double-headed arrow 210, the horizontal direction of the drawing) and first and second lateral edges 206 and 208 running along a lateral direction (indicated by double-headed arrow 212, the vertical direction of the drawing) and thus normal to the longitudinal direction 210. The lateral edges 206 and 208 may each be divided into several individual sections, as shown.

The side panels 26 are integrally connected to the bottom 22 along fold lines 32 which extend along the longitudinal direction 210 and are to be folded up along the fold lines 32 to the upright position shown in FIG. 2 during the formation of the receptacle 28. The side panels 26 are further divided by two spaced and parallel fold lines 37 extending in the longitudinal direction 210 into an outer side section 302, a central section 304 and an inner side sections 306.

Each of the outer side sections 302 of the side panels 26 has formed on two opposite ends thereof an end section 34 which is connected to the outer side section 302 of the side panel 26 along a fold line 36 running in the lateral direction 220 so as to be foldable relative to the outer side section 302 to be substantially normal to the side panel 26 and the bottom 22, namely substantially parallel with the respective end panel 24, when the receptacle 28 has been fully assembled.

The second fold line 36 is further extended from the first longitudinal edge 202 to the second longitudinal edge 204 to define the end panel 24. The end panel 24 has formed thereon a first pair of cutouts 44 and a second pair of cutouts 46 to divide the end panel 24 into three sections, two side sections 48 and a central section 50. The cutouts 46 have a bottom edge coincident with the second fold line 36, while each of the cutout 44 comprises a flap 42 connected to end of each of the inner side section 306 to be foldable along the respective second fold line 36. The flap 42 has a depth corresponding to the height of the central section 304 of the side panel 26 so as to close the end gap defined between the inner and outer sections 302 and 306 when the receptacle 28 is assembled.

Each of the first cutouts 44 is located between one of the end sections 34 of the side panels 26 and the adjacent side section 48 of the end panel 24 and each of the second cutouts 46 is located between one of the side sections 48 and the central section 50 of the end panel 24.

Each of the end sections 34 has formed on the free end thereof two flaps 341 which are formed by forming two slits 342 on the flap 34, the slits 342 being respectively extending from the first longitudinal edge 202 and an opposite edge 343 of the end section 34 toward each other along a common line running substantially parallel with the lateral direction 212, but not interconnecting each other. In the embodiment illustrated, each of the slits 342 occupies approximately one third of the height of the end section 34 (the dimension measured from the fold line 32 to the first longitudinal edge 202) so as to leave approximately one third of the height of the end section 34 uncut and integrally connected to the end section 34. A fold line 344 extends from the inner end of each of the slits 342 to the free edge of the end section 34 and thus substantially normal to the slit 342 so as to allow the flaps 341 to be foldable along the fold lines 344.

Each of the side sections 48 of the end panel 24 has a slit 52 extending in the longitudinal direction to intersect the respective fold line 36 and preferably having a length of substantially half the height of the end panel 24 measured in the longitudinal direction between the fold line 36 and the adjacent lateral edge 206 or 208 of the blank 200. A further slit 54 is formed along a portion of the fold line 36 from the intersection of the fold line 36 and the slit 52 to the adjacent second cutout 46.

The central section 50 of the end panel 24 has formed thereon two slits 56, spaced from each other and extending to the respective lateral edge 206 or 208 of the blank 200 and preferably having a length of substantially half the height of the end panels 24.

Each of the side sections 48 of the end panels 24 further has a hole or slot 58 formed thereon to correspond to the flaps 341 of the adjacent end section 34 of the side panel 26, which is so dimensioned to allow the flaps 341, after being folded along the fold lines 344, to insert into the hole 58 in assembling the receptacle 28. The flaps 344 are then allowed to resume, at least partly, their unfolded positions so as to secure the end section 34 of the side panel 26 to the side section 48 of the end panel 24, as shown in FIG. 2.

The bottom section 22 of the blank 200 has formed thereon a number of fold line sets, which is two in the illustrated embodiment, each comprising a central fold line 62 and two side fold lines 64 arranged on two sides of the central fold line 62 and spaced a pre-determined distance X therefrom to each define a zone. All the fold lines 62 and 64 extend in the longitudinal direction 210 of the blank 200 and between the two fold lines 36. Each fold line set comprises a plurality of lamp retaining hole pairs 66 spaced along the central fold line 62. Each of the lamp retaining hole pairs 66 comprises two holes 68, each located within one of the zones defined by the spacing X and sized to receive a lamp 29 therein and arranged symmetrical about the central fold line 62. Each of the holes 68 has a bottom rectangular slot 72 connected thereto. A connection slit 70 extends between the two holes 68 of each of the hole pairs 66 and across the central fold line 62.

Preferably, each fold line set of the bottom section 22 is associated with one of the second cutouts 46 of the end panels 24.

Corresponding to each of the hole pairs 66, a hole 74 is formed on the inner side section 306 of each of the side panels 26.

The first and second cutouts 44 and 46 provided on each of the end panels 24 allow the bottom section 22 to be folded along the central fold line 62 and side fold lines 64 of each fold line set thereof so as to define an inverted V-shaped ridge 76 (FIG. 2). In the specific embodiment, the number of the ridges 76 is two. With the formation of the ridges 76, the side sections 48 of each of the end panels 24 are allowed to partly overlap the central section 50 of the end panel 24 to have the slit 52 of each of the side sections 48 matingly engage the respective slit 56 of the central section 50. By such engagements, the inverted V-shaped ridges 76 that are formed by the fold line sets (fold lines 62 and 64) of the bottom section 22 of the blank 200 are maintained, as that illustrated in FIG. 2.

Also, each of the side panels 26 is folded along the fold lines 37 thereof to have the side sections 302 and 306 thereof substantially parallel with each other with the central section 304 bridging therebetween to form a double layer side panel structure wherein the inner side section 306 faces the adjacent ridge 76 while the outer side section 302 faces outward. Under this situation, the inner and outer sections 302 and 306 that are opposite to each other and define two opposite open ends that are closed by folding the flaps 42 about the fold lines 36.

Further, each of the end sections 34 of each of the side panels 26 is secured to the adjacent side section 48 of the respective end panel 24 by having the flaps 341 thereof inserted into and received within the respective hole 58 formed on the side section 48 of the end panel 24 to have the end section 34 of the side panel 26 retained to the side section 48 of the end panel 24 by restoring the unfolded condition of the flaps 341. This maintains the double layer side panel structure in the upright position and also keeps the end panel 24 to be upright when fully assembled.

The ridges 76 that are formed by the fold lines 62 and 64 of the bottom section 22 and having a plurality of hole pairs 66 formed thereon for receiving and retaining the lamps 29 serves as the lamp securing means 30 that has a plurality of lamp retaining seats (defined by the hole pairs 66) spaced along each of the ridges 76 to each receive a lamp 29 therein with the lamp bulb 80 projecting out of one of the holes 68 of the hole pair 66 and the lamp base 82 remaining within the other hole 68 of the hole pair 66 have the lamp 29 securely retained within the hole pair 66. Tip of each of the lamp bulbs 80 is received within the corresponding hole 74 formed on the side panels 26 to further secure the lamp 29. If the lamp 29 is provided with a clip 84, then the clip 84 of the lamp 29 may be received and retained within the slots 72 of the lamp retaining seat 66. The wires 86 of the lamps 29 can be arranged within the space between the two inverted V-shaped ridges 76.

Although a preferred embodiment has been described to illustrate the present invention, it is apparent that changes and modifications in the specifically described embodiment, such as increasing the number of the inverted V-shaped ridges and simultaneously increasing the number of the central section of the end panel to be more than one, can be carried out without departing from the scope of the invention which is intended to be limited only by the appended claims.

What is claimed is:

1. A lamp string holding container formed from a single sheet of paperboard blank, comprising a bottom section having two side opposite panels defined by two first fold lines extending on the bottom section in a first direction to be folded along the first fold lines to an upright position substantially normal to the bottom section and two opposite end panels defined by two second fold lines extending on the bottom section in a second direction to be folded along the second fold lines to an upright position normal to the bottom section, each of the side panels comprising an inner side section, a central section and an outer side section defined by two parallel third fold lines running parallel with the first fold lines so as to allow each of the side panels to be further folded along the third fold lines to form a double layer structure with the inner and outer side sections substantially parallel with each other, substantially normal to the bottom section and connected by the central section, the outer side section of each of the side panels having two opposite end sections extending from ends thereof in the first direction and each having first retaining means formed thereon to secure to the end panel so as to maintain both the side and end panels in the folded, upright positions relative to the bottom section, each of the end panels having two first cutouts formed adjacent the respective end section of each of the side panels with bottoms of the first cutouts coincident with the respective second fold line and at least one pair of second cutouts formed along the respective second fold line and between the first cutouts with bottoms of the second cutouts coincident with the respective second fold line so as to divide the end panel into two side sections, defined between the first cutouts and the corresponding second cutouts, and at least one central section, defined between the second cutouts, second retaining means being provided between each of the end panel side section and the central section, the bottom section further comprising a plurality of fold line sets, each corresponding to one of the second cutouts and comprising a central fold line and two side fold lines arranged on two sides of the central fold line extending in the first direction between the two second fold lines to allow the bottom section to be folded along the central fold line and the side fold lines of each fold line set, with the end panel side sections partially overlapping the end panel central section and secured thereto with the second retaining means, so as to form and maintain an inverted V-shaped ridge substantially extending along the first direction, the central fold line being top of the ridge and the side fold lines being feet of the ridge, each of the ridges being provided with a plurality of lamp securing seats spaced along the first direction to receive and retain therein a lamp of the lamp string.

2. The lamp string holding container as claimed in claim 1, wherein the paperboard blank has two opposite first edges extending in the first direction and two opposite second edges extending in the second direction and wherein the first retaining means comprises two opposite flaps formed on each of the end sections of the side panels, each defined by a slit extending from two opposite edges of the end section toward each other, but not interconnected each other, a fold line substantially normal to and extending from an inner end of each of the slits to allow each of the flaps to be foldable about the fold line to be insertable and received within a corresponding hole formed on the adjacent side section of the end panel.

3. The lamp string holding container as claimed in claim 2, wherein each of the inner sections of the side panels has formed on each of two opposite ends thereof a flap having a depth substantially corresponding to height of the central section of each of the side panels measured between the inner side section and the outer side section, the flap being foldable about the respective second fold line.

4. The lamp string holding container as claimed in claim 1, wherein the second retaining means comprises a first slit formed on each of the end panel side sections and extending in the first direction to intersect the respective second fold line and a second slit extending along a portion of the respective second fold line from the intersection of the first slit and the second fold line to the adjacent second cutout so as to allow the first slit to matingly engage a third slit formed on the end panel central section and extending in the first direction to the respective second edge of the blank.

5. The lamp string holding container as claimed in claim 4, wherein each of the end panels has a height measured in the first direction and the first slit of the end panel side section takes approximately one half of the end panel height and the third slit takes approximately one half of the end panel height.

6. The lamp string holding container as claimed in claim 1, wherein each of the fold line sets that are formed on the bottom section defines two zones respectively between the central fold line and the two side fold lines and wherein each of the lamp securing seats comprises two holes respectively formed on the two zones to be opposite to each other with a slit extending therebetween and across the central fold line, each of the holes being distant from the respective side fold line and a slot being integrally formed with each of the holes to be located between the hole and the side fold line.

7. The lamp string holding container as claimed in claim 6, wherein each of the inner sections of the side panels has a plurality of holes formed thereon to each correspond to one of the lamp securing seats.

8. A blank for making a lamp string holding container, wherein the lamp string holding container comprising a bottom with two double-layered side panels and two end panels and a plurality of inverted V-shaped ridges formed on the bottom, the blank comprising a bottom section having two first edges running along a first direction and two second edges running along a second direction, two first fold lines being provided on the bottom section to extend along the first direction to define two side panel sections and two second fold lines being provided on the bottom section to extend along the second direction to define two end panel sections, each of the side panels having two substantially parallel fold lines running in the first direction and dividing the side panel into an inner side section, a central section and an outer side section, the outer side section having formed on two opposite ends thereof two end sections defined by a fold line running in the second direction, two first cutouts being formed on each of the end panels to each juxtapose an adjacent end section of one of the side panels with bottoms of the first cutouts coincident with the respective second fold line, each of the end panels further comprising two spaced second cutouts formed thereon between the first cutout with bottoms of the second cutouts coincident with the respective second fold line so to define a central section of the end panel, each of the second cutouts together with the adjacent first cutout defining a side section of the end panel, each of the end sections of the side panels having two opposite flaps formed thereon to be foldable about fold lines collinear with each other and extending parallel with the first direction to be insertable and received and retained within a hole formed on the adjacent end panel side section at such a location adapted to receive and retain the flaps of the end section therein when the container is fully assembled, each of the end panel side sections further comprising a slit extending in the first direction to intersect the respective second fold line and a further slit extending along a portion of the second fold line from the intersection of the previously mentioned slit and the second fold line to the adjacent second cutout to define a pivotable flap and a corresponding slit being provided on the end panel central section to extend in the first direction to the second edge of the blank adapted to matingly engage the pivotable flap of the end panel side section when the container is fully assembled, the bottom section having a plurality of fold line sets each corresponding to one of the second cutouts and comprising a central fold line and two side fold lines arranged on two sides of the central fold line to define with the central fold line two zones, a plurality of hole pairs being formed along the central fold line and each comprising two holes symmetrically formed on the two zones with a slit extending therebetween and across the central fold line, each of the holes having a slot integrally formed therewith, the inner side section of each of the side panels having a plurality of holes formed thereon to each correspond to one of the hole pairs along the central fold line, a flap being formed on each of two opposite ends of the inner side section of each of the side panels having a depth corresponding to height of the central section of the side panel measured between the inner and outer side sections of the side panel to be foldable about the respective second fold line.

* * * * *